US009231346B2

(12) United States Patent
Okano

(10) Patent No.: US 9,231,346 B2
(45) Date of Patent: Jan. 5, 2016

(54) CONNECTOR

(71) Applicant: Sumitomo Wiring Systems, Ltd., Yokkaichi (JP)

(72) Inventor: Tomoki Okano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/506,729

(22) Filed: Oct. 6, 2014

(65) Prior Publication Data

US 2015/0111406 A1 Apr. 23, 2015

(30) Foreign Application Priority Data

Oct. 18, 2013 (JP) ..... 2013-217511

(51) Int. Cl.
*H01R 13/639* (2006.01)
*H01R 13/627* (2006.01)

(52) U.S. Cl.
CPC ..... *H01R 13/639* (2013.01); *H01R 13/6272* (2013.01)

(58) Field of Classification Search
CPC ..... H01R 13/639
See application file for complete search history.

(56) References Cited

U.S. PATENT DOCUMENTS

| | | | | | |
|---|---|---|---|---|---|
| 4,938,710 | A * | 7/1990 | Aihara et al. | ..... | 439/345 |
| 5,017,147 | A * | 5/1991 | Sugiyama et al. | ..... | 439/144 |
| 5,234,356 | A * | 8/1993 | Maejima et al. | ..... | 439/352 |
| 6,024,595 | A * | 2/2000 | Saba et al. | ..... | 439/489 |
| 2008/0096414 | A1* | 4/2008 | Hiramatsu | ..... | 439/370 |
| 2011/0008988 | A1 | 1/2011 | Urano et al. | | |
| 2011/0021060 | A1* | 1/2011 | Urano et al. | ..... | 439/352 |
| 2011/0045684 | A1* | 2/2011 | Morino et al. | ..... | 439/357 |
| 2011/0104930 | A1* | 5/2011 | Seong et al. | ..... | 439/345 |
| 2015/0111406 | A1* | 4/2015 | Okano | ..... | 439/352 |

* cited by examiner

*Primary Examiner* — James Harvey
(74) *Attorney, Agent, or Firm* — Gerald E. Hespos; Michael J. Porco; Matthew T. Hespos

(57) ABSTRACT

A connection detector (40) is mounted on a lock arm (20) of a first housing (10) and is movable in a direction interesting a resilient displacement direction of a lock arm (20) between an initial position and a detection position. The first housing (10) is formed with supporting wall portions (16) substantially parallel to the resilient displacement direction of the lock arm (20). The supporting wall portions (16) are formed with recesses (17). The connection detector (40) is formed with projections (46) that fit into the recesses (17) for restricting a displacement of the lock arm (20) in an unlocking direction when the connection detector (40) is at the detection position.

9 Claims, 15 Drawing Sheets

CONNECTOR

BACKGROUND

1. Field of the Invention

The invention relates to a connector.

2. Description of the Related Art

US Patent Application Pub. No. 2011/0008988 discloses a connector with a female housing and a male housing. The female housing includes a receptacle, a locking band and a detector. The male housing is formed with a lock. The locking band is displaced resiliently in an unlocking direction when the two housings are half-connected. Thus, a movement of the detector toward the receptacle is restricted. The locking band resiliently returns when the two housings are connected properly and the detector can move into the receptacle. The detector is in contact with an inner wall surface of the receptacle when the detector is locked in the receptacle, thereby restricting a movement of the locking band in the unlocking direction.

An operating force in the unlocking direction applied to the locking band portion is received by the inner wall surface of the receptacle via the detector. At this time, a direction of the force acting on the receptacle is parallel to a wall thickness direction of the receptacle. The rigidity of the receptacle in the wall thickness direction is structurally weak. Thus, if the operating force in the unlocking direction applied to the locking band is strong, the receptacle may be deformed and the locking band may be displaced in the unlocking direction.

The invention was completed based on the above situation and aims to improve the reliability of a locking function.

SUMMARY OF THE INVENTION

The invention relates to a connector that has first and second housings that are connectable to one another. A lock arm is formed in the first housing and is displaced resiliently in an unlocking direction in the process of connecting the two housings and resiliently returns to a locking position when the housings are connected properly. A connection detector is mountable on the lock arm and is movable in a direction intersecting a resilient displacement direction of the lock arm between an initial position and a detection position. The connection detector is kept at the initial position when the lock arm is displaced in the unlocking direction, but can move to the detection position when the two housings are connected properly and the lock arm has returned resiliently to the locking position. A supporting wall is formed in the first housing and is substantially parallel to the resilient displacement direction of the lock arm. A recess is formed in a surface of the supporting wall. A projection is formed on the connection detector and restricts a displacement of the lock arm in the unlocking direction by fitting into the recess when the connection detector is at the detection position.

An operating force in the unlocking direction applied to the lock arm is received by the connection detector and the recess via the projection of the connection detector. The supporting wall formed with the recess stands up substantially parallel to the resilient displacement direction of the lock arm and is highly rigid against the operating force in the unlocking direction acting on the recess. Thus, a resilient displacement of the lock arm in the unlocking direction can be restricted reliably.

The recess may be a groove that extends parallel to a moving direction of the connection detector. The projection and the recess may not correspond in a state where the connection detector is at the initial position; and the projection may slide in contact with the recess in the moving process of the connection detector from the initial position to the detection position. According to this configuration, the connection detector is guided smoothly since being guided by the sliding contact of the projection and the recess when moving between the initial position and the detection position.

The projection may be a rib extending parallel to the moving direction of the connection detector. Thus, the posture of the connection detector is stabilized during a movement.

A movement restricting portion may be formed in the housing to restrict movement of the connection detector toward the detection position. The movement restricting portion may proximately face the projection when the lock arm is displaced resiliently in the unlocking direction. An attempt may be made to move the connection detector forcibly to the detection position while the two housings are half-connected. However, the projection contacts the movement restricting portion and prevents a movement of the connection detector to the detection position.

DETAILED DESCRIPTION

Figure 1:
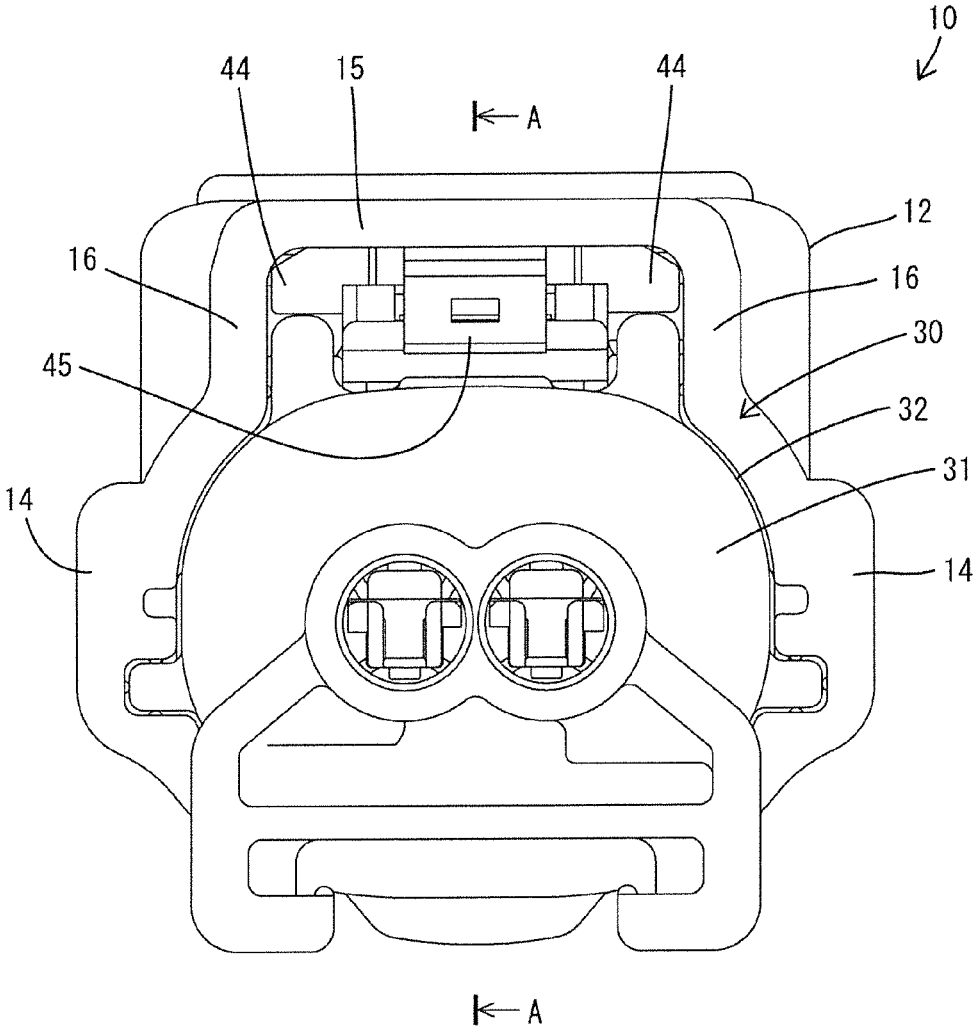
FIG. 1 is a front view of a first housing in a state connected to a second housing in one embodiment.

A connector in accordance with an embodiment of the invention includes a first housing 10, a second housing 30 and a connection detector 40, as shown in FIGS. 1 to 5. In the following description, a front-back direction is based on the first housing 10 and a left side in FIGS. 2 to 5, 7 to 9 is referred to as a front. Further, a vertical direction is based on orientations shown in FIGS. 1 to 6.

The first housing 10 is made unitarily of synthetic resin and includes a terminal accommodating portion 11 and a tubular fitting 12 surrounding the terminal accommodating portion 11, as shown in FIGS. 2 to 5 and 10. Female terminal fittings (not shown) of a known form are to be accommodated in the terminal accommodating portion 11. The tubular fitting 12 has a lower wall 13 facing the lower surface of the terminal accommodating portion 11. Bilaterally symmetrical side walls 14 stand up from opposite left and right sides of the lower wall 13 and are located to sandwich the terminal accommodating portion 11 from left and right sides. An upper wall 15 couples front end parts of the side walls 14. Rear ends of the lower wall 13 and the side walls 14 are connected to a rear end part of the outer peripheral surface of the terminal accommodating portion 11.

Figure 7:
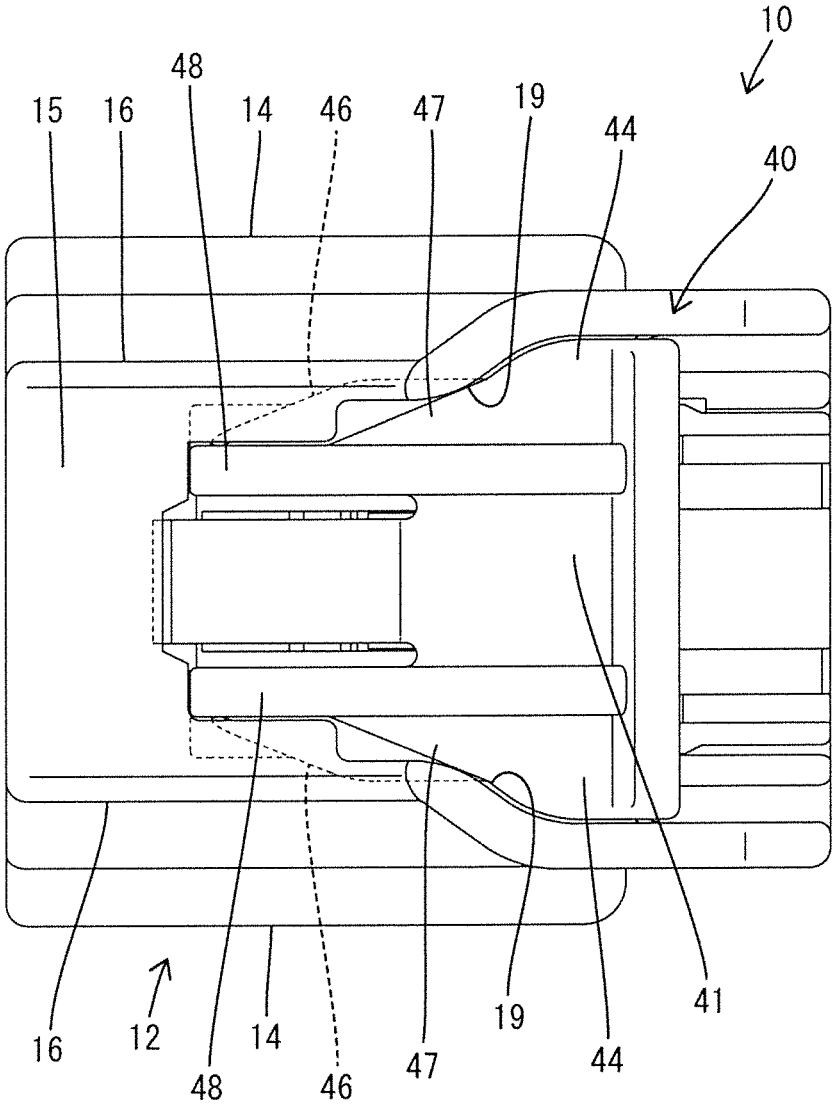
FIG. 7 is a plan view of the first housing showing the state where the connection detector has moved to the detection position.
Figure 8:
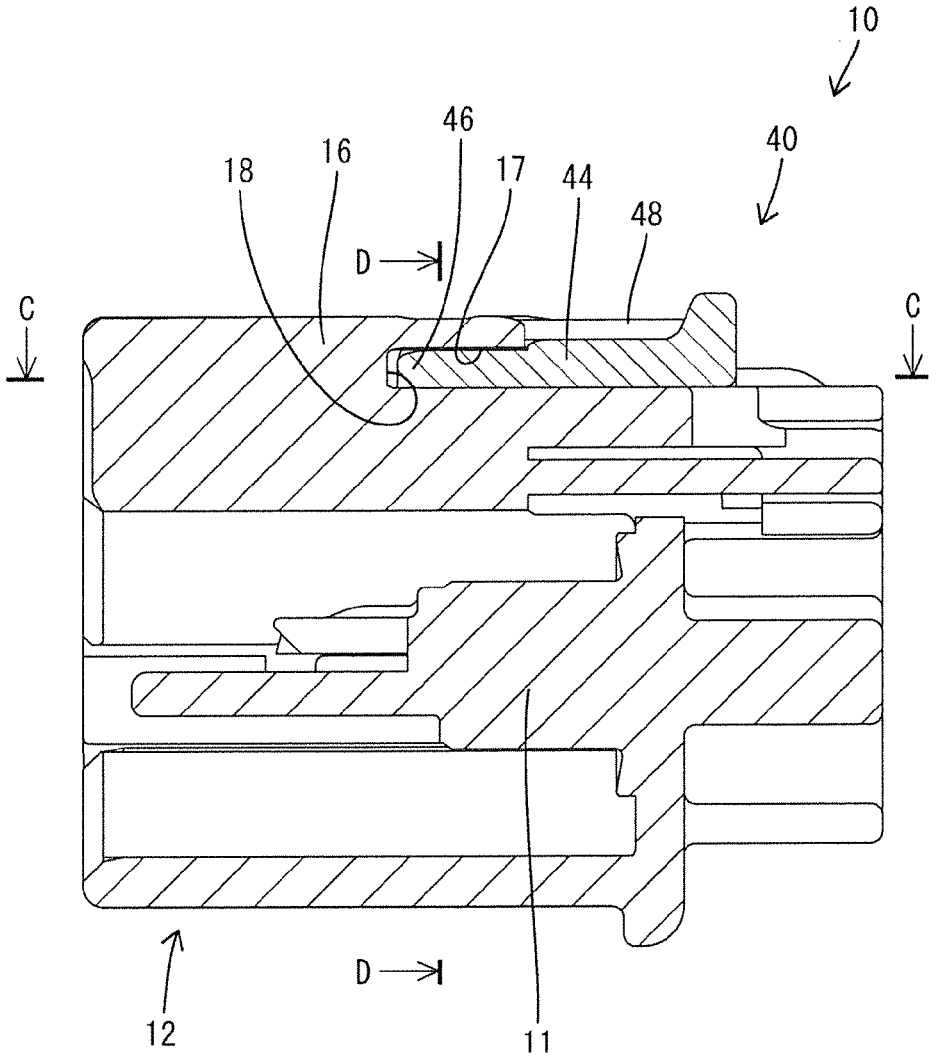
FIG. 8 is a section along B-B of FIG. 6.
Figure 9:
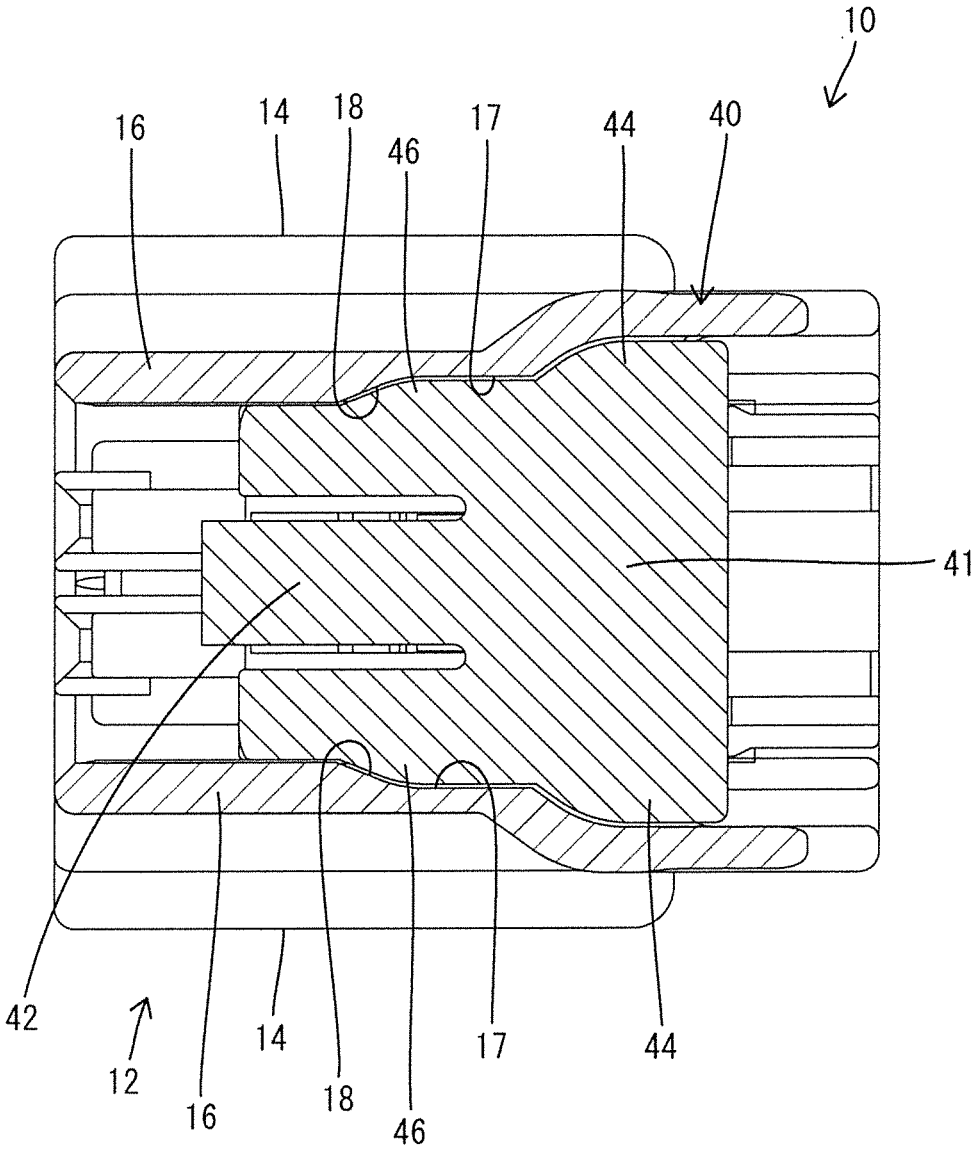
FIG. 9 is a section along C-C of FIG. 8.
Figure 10:
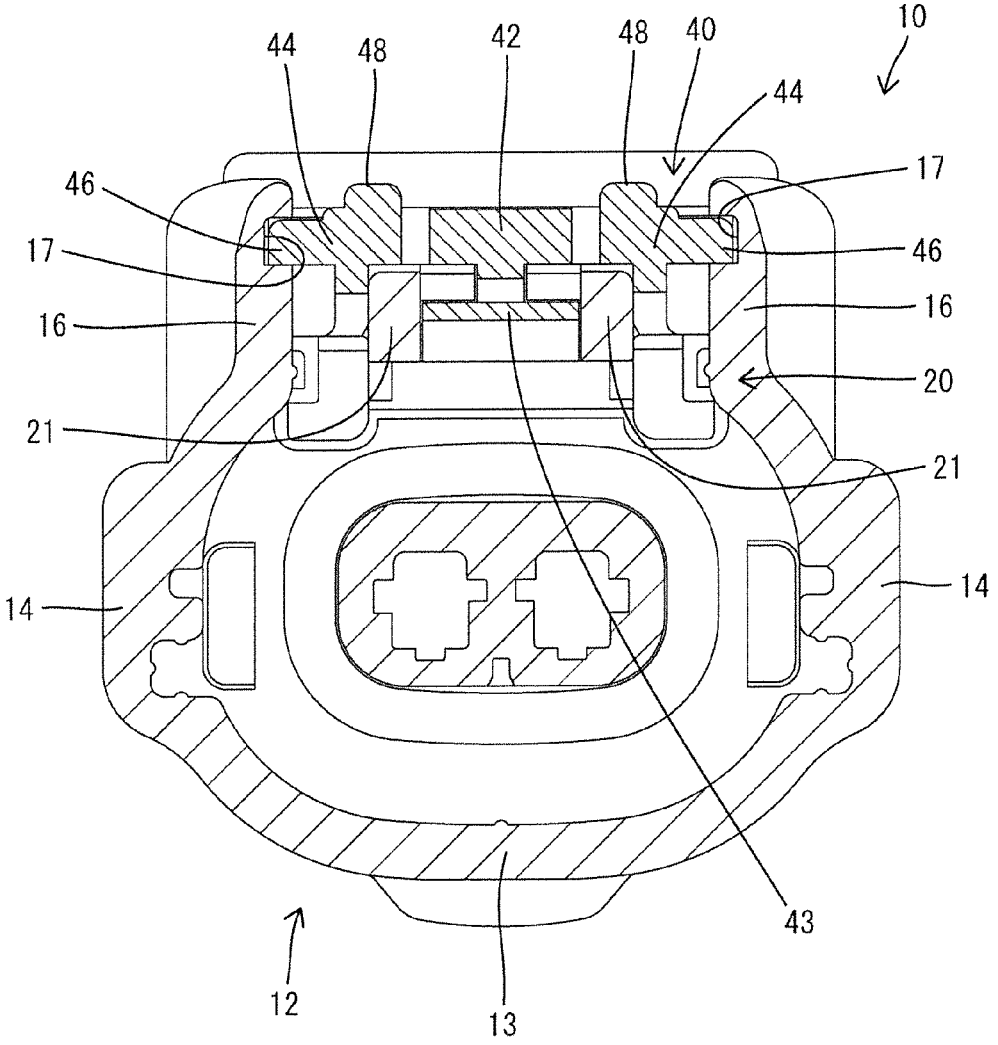
FIG. 10 is a section along D-D of FIG. 8.

As shown in FIGS. 1 and 10, substantially front half areas of upper parts of the left and right side walls 14 define bilaterally symmetrical supporting panels 16 standing vertically up in directions parallel to a resilient displacement direction of a lock arm 20. The upper wall 15 couples front end parts of both supporting panels 16. The inner surfaces of the supporting panels 16 face each other and are formed with bilaterally symmetrical recesses 17. As shown in FIGS. 7 to 9, the recesses 17 extend straight in the front-back direction (direction parallel to a moving direction of the connection detector 40). Formation ranges of the recesses 17 in the front-back direction are rear end areas of the supporting panels 16. The rear ends of the recesses 17 are open toward rear ends of the supporting panels 16. The front ends of the recesses 17 define front stops 18 oblique to the front-back direction in a plan view. The front stops 18 position the connection detector 40 at a detection position by bringing the front end edges of projections 46 of the connection detector 40 into contact therewith.

Figure 11:
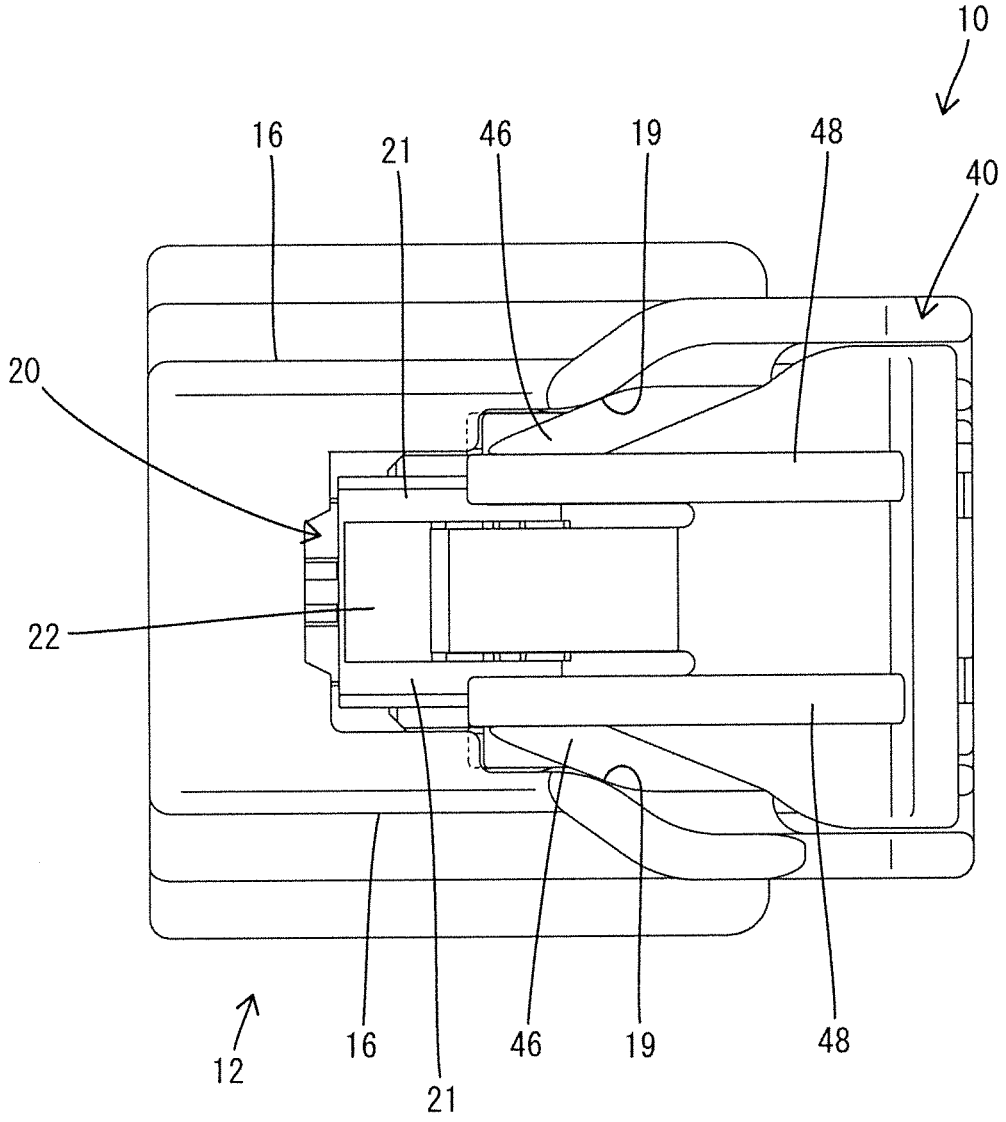
FIG. 11 is a plan view of the first housing showing the state where the connection detector is at the initial position.
Figure 12:
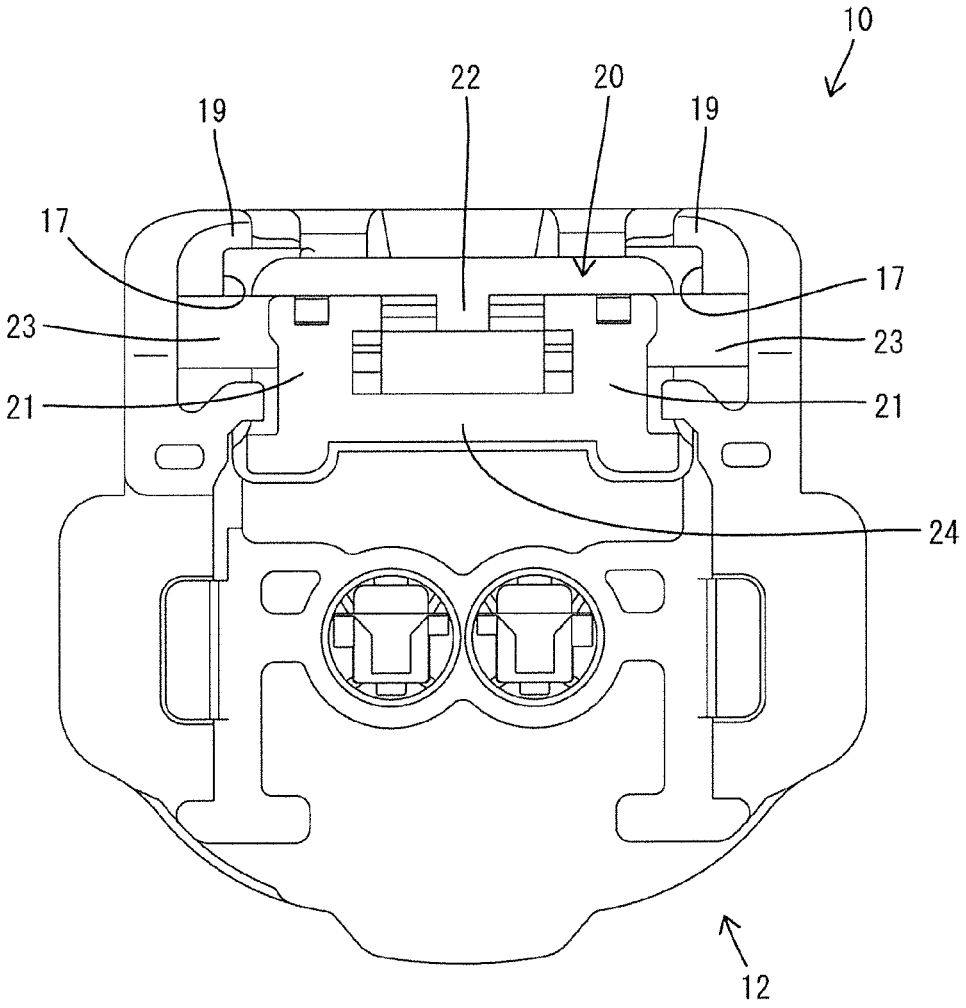
FIG. 12 is a rear view of the first housing alone.

As shown in FIGS. 7, 11 and 12, two bilaterally symmetrical movement restricting portions 19 are formed on the upper parts of the left and right side walls 14. The movement restricting portions 19 are arranged behind and adjacent to the rear ends of the supporting panels 16 in the front-back direction and above and adjacent to the recesses 17 in the vertical direction. The movement restricting portions 19 are oblique to the front-back direction in a plan view and restrict movement of the connection detector 40 to the detection position when the lock arm 20 is displaced resiliently in the unlocking direction and also restrict any further forward movement of the connection detector 40 when the lock arm 20 has returned resiliently to a locking position and the connection detector 40 has moved to the detection position.

Figure 13:
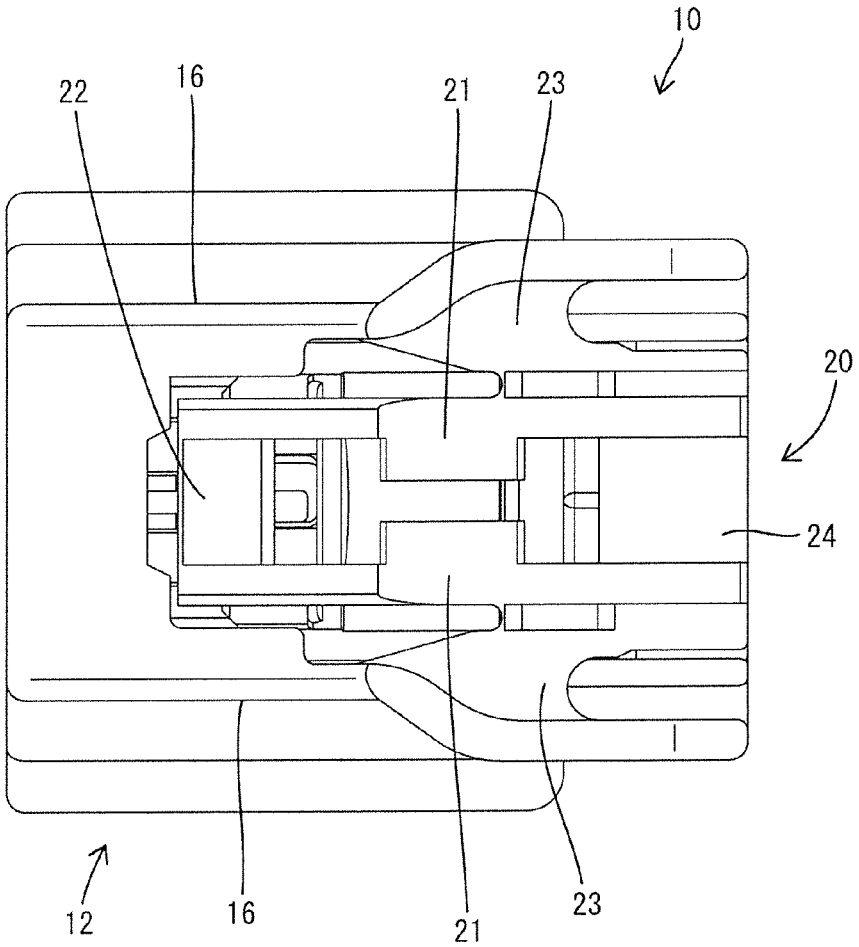
FIG. 13 is a plan view of the first housing alone.

The lock arm 20 is unitary with the first housing 10 and extends along the upper surface of the terminal accommodating portion 11. As shown in FIGS. 12 and 13, the lock arm 20 has two bilaterally symmetrical arms 21 extending in the front-back direction and an interfering portion 22 couples front parts of the arms 21. Left and right supports 23 project from the outer surfaces of both arms 21 substantially in a central part in the front-back direction and are connected to the inner wall surfaces of the side walls 14. A coupling 24 couples rear end parts of the arms 21. The lock arm 20 normally is held at the locking position (see FIGS. 2, 4 and 5) due to the rigidity thereof, but is resiliently displaceable to displace the interfering portion 22 up in the unlocking direction (see FIG. 3).

The second housing 30 includes a terminal holding portion 31 and a receptacle 32 extending from the outer periphery of the terminal holding portion 31. Male terminal fittings (not shown) of a known form are held in the terminal holding portion 31. A lock 34 projects on an outer surface of an upper plate 33 of the receptacle 32. The receptacle 32 is inserted into a space between the terminal accommodating portion 11 and the tubular fitting 12 to surround the terminal accommodating portion 11 when the two housings 10, 30 are connected. Additionally, the upper plate 33 of the receptacle 32 is inserted between the upper surface of the terminal accommodating portion 11 and the lower surface of the lock arm 20 when the two housings 10, 30 are connected.

Figure 14:
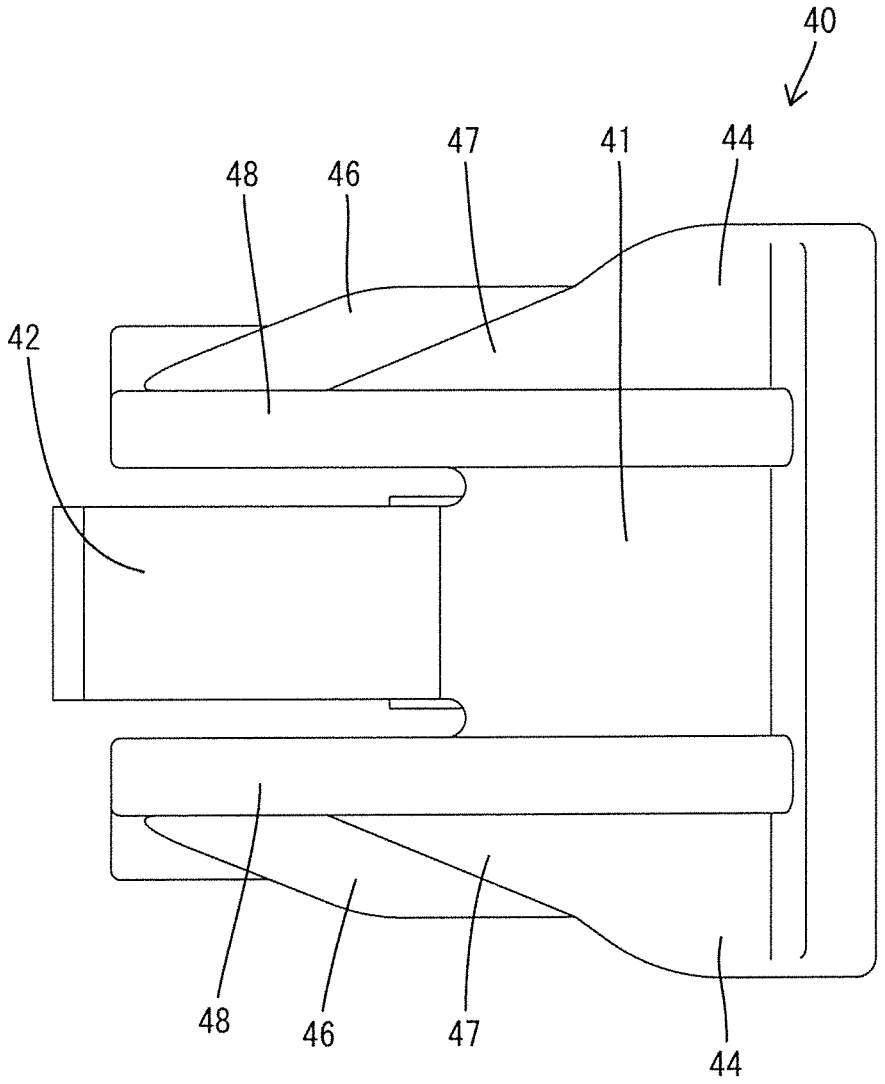
FIG. 14 is a plan view of the connection detector.
Figure 15:
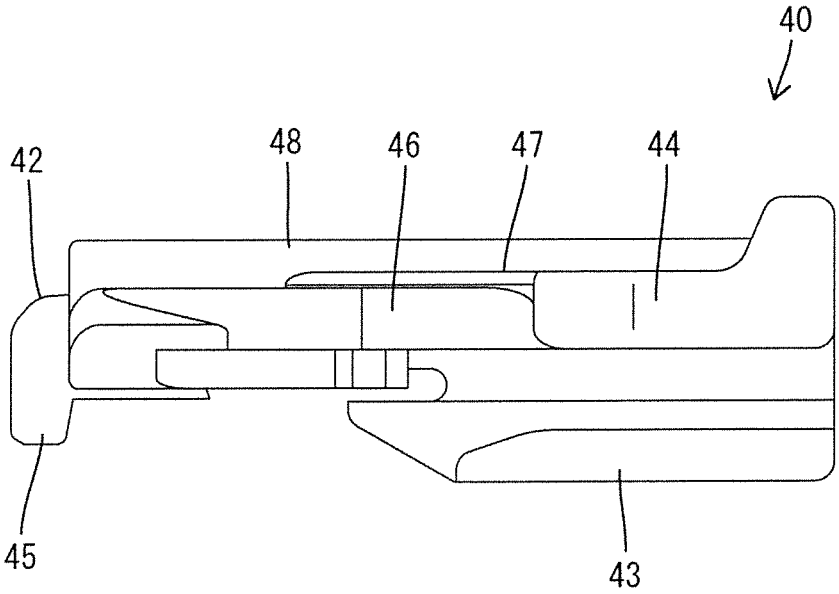
FIG. 15 is a side view of the connection detector.
Figure 16:
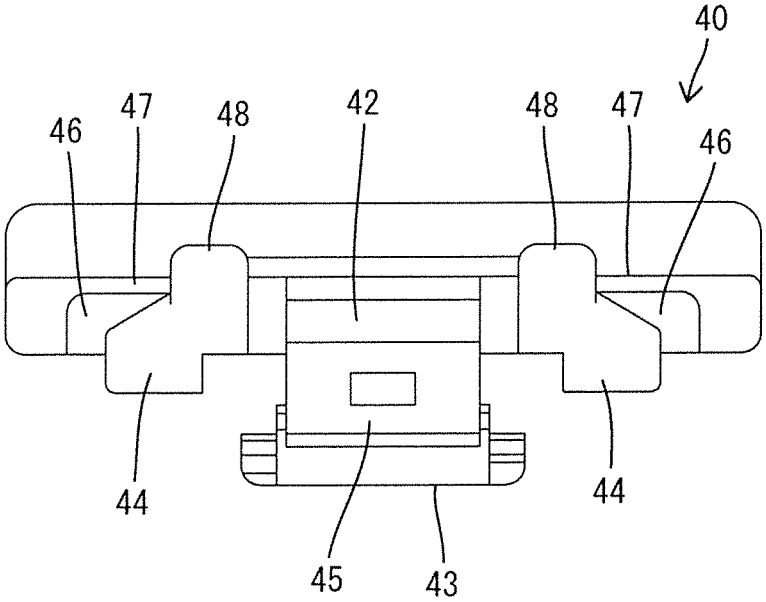
FIG. 16 is a front view of the connection detector.

The connection detector 40 is made of synthetic resin and, as shown in FIGS. 14 to 16, has a flat and bilaterally symmetrical shape with a small height. The connection detector 40 includes a plate-like main body 41, a plate-like deflecting portion 42, a leg 43 and two bilaterally symmetrical wings 44. The main body 41 has a substantially rectangular planar shape and the deflecting portion 42 is cantilevered forward from the front end of the main body 41. A butting portion 45 projects down from the front end extending end of the deflecting portion 42. The leg 43 projects from the lower surface of the main body portion 41 and has a vertically inverted T shape in a front view.

The wings 44 extend in the front-back direction and sandwich the main body 41 and the deflecting portion 42 from left and right sides. Rear half areas of the wings 44 are connected to the left and right sides of the main body 41, and front half areas of the wings 44 are spaced apart from opposite side edges of the deflecting portion 42. Reinforcing ribs 48 are formed on the upper surfaces of the wings 44 at inner side edges of the wings 44 and extend in the front-back direction. The reinforcing ribs 48 enhance the rigidity of the wings 44 from the front ends to the rear ends and enhance the rigidity of the entire left and right side parts of the main body 41 from the front ends to the rear ends. Thus, the wings 44 and the main body 41 will not curve or deform even if a vertical external force is applied to the projections 46.

The front area of the wing 44 defines the projection 46 bulging out in a width direction. The front end edge of the projection 46 is oblique to the front-back direction in a plan view. Further, the substantially rear half area of the wing 44 defines a thick portion 47. The upper surface of the thick portion 47 is slightly higher than the upper surface of the projection 46. The front end edge of the thick portion 47 is also oblique to the front-back direction in a plan view similarly to the projection 46.

The connection detector 40 is mounted on the lock arm 20 for relative displacement in the front-back direction. That is, the connection detector 40 is movable between an initial position (see FIGS. 2 to 4 and 11) and the detection position (see FIGS. 5, 7 to 9) located before the initial position. The connection detector 40 is guided for forward and backward movement relative to the lock arm 20 by causing the leg 43 to slide in contact with both arms 21 in a state sandwiched in a space between the arms 21 and causing the main body 41 to slide in contact with the upper surfaces of the arms 21.

The connection detector 40 mounted on the lock arm 20 is normally at the initial position with the butting portion 45 of the connection detector 40 in contact with the interfering portion 22 of the lock arm 20 from behind. Thus, the connection detector 40 cannot move to the detection position. Further, the projections 46 are at the same height as the recesses 17 in the vertical direction substantially parallel to the unlocking direction of the lock arm 20 when the lock arm 20 is at the locking position. Further, the front ends of the projections 46 are behind and near the rear ends of the recesses 17 in the front-back direction, i.e. at positions so that the projections 46 can be displaced up without interfering with the supporting panels 16. Note that, at the initial position, a backward displacement of the connection detector 40 relative to the lock arm 20 is restricted by unillustrated locking means.

Figure 2:
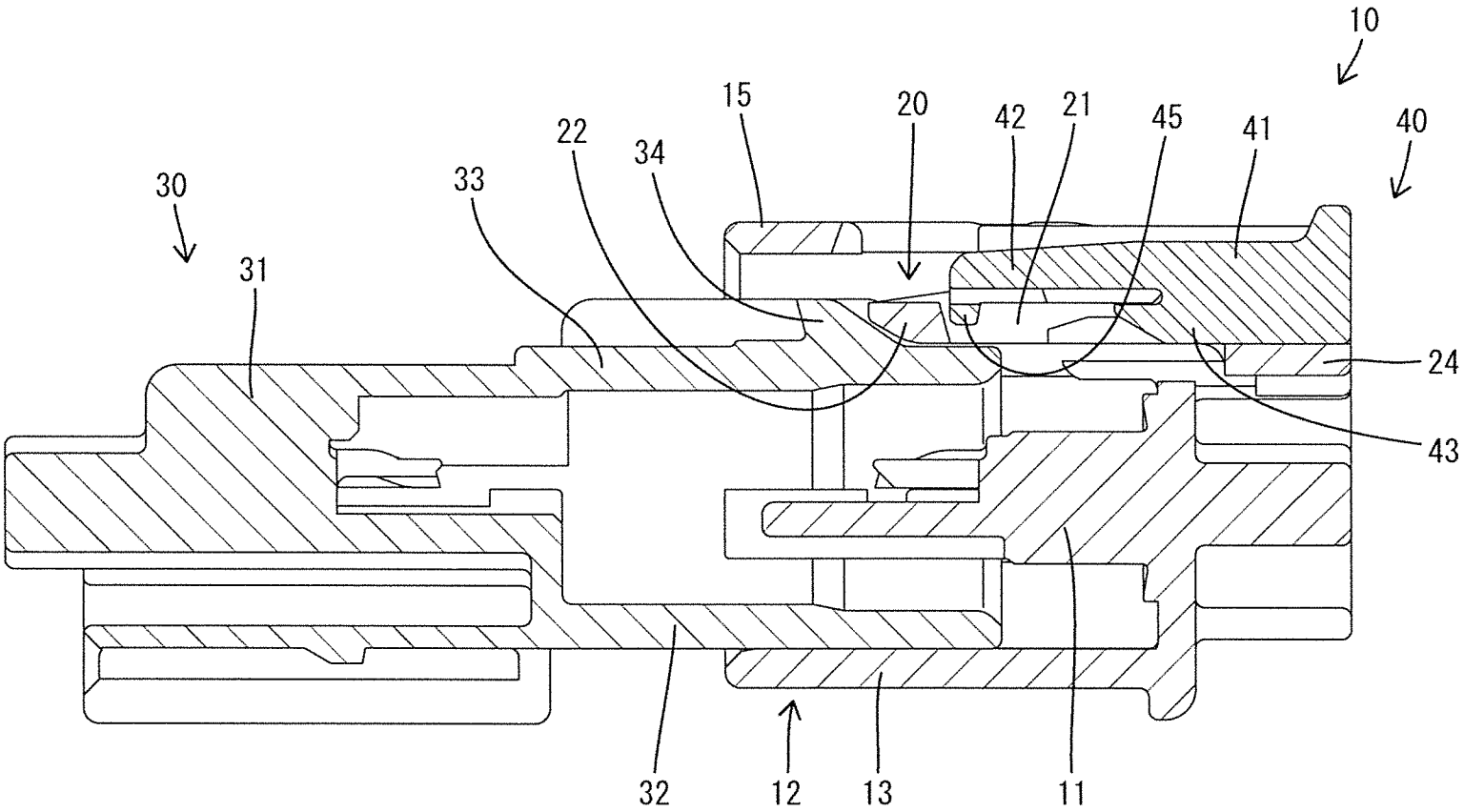
FIG. 2 is a section along A-A of FIG. 1 showing a state where the connection of the two housings is started.
Figure 3:
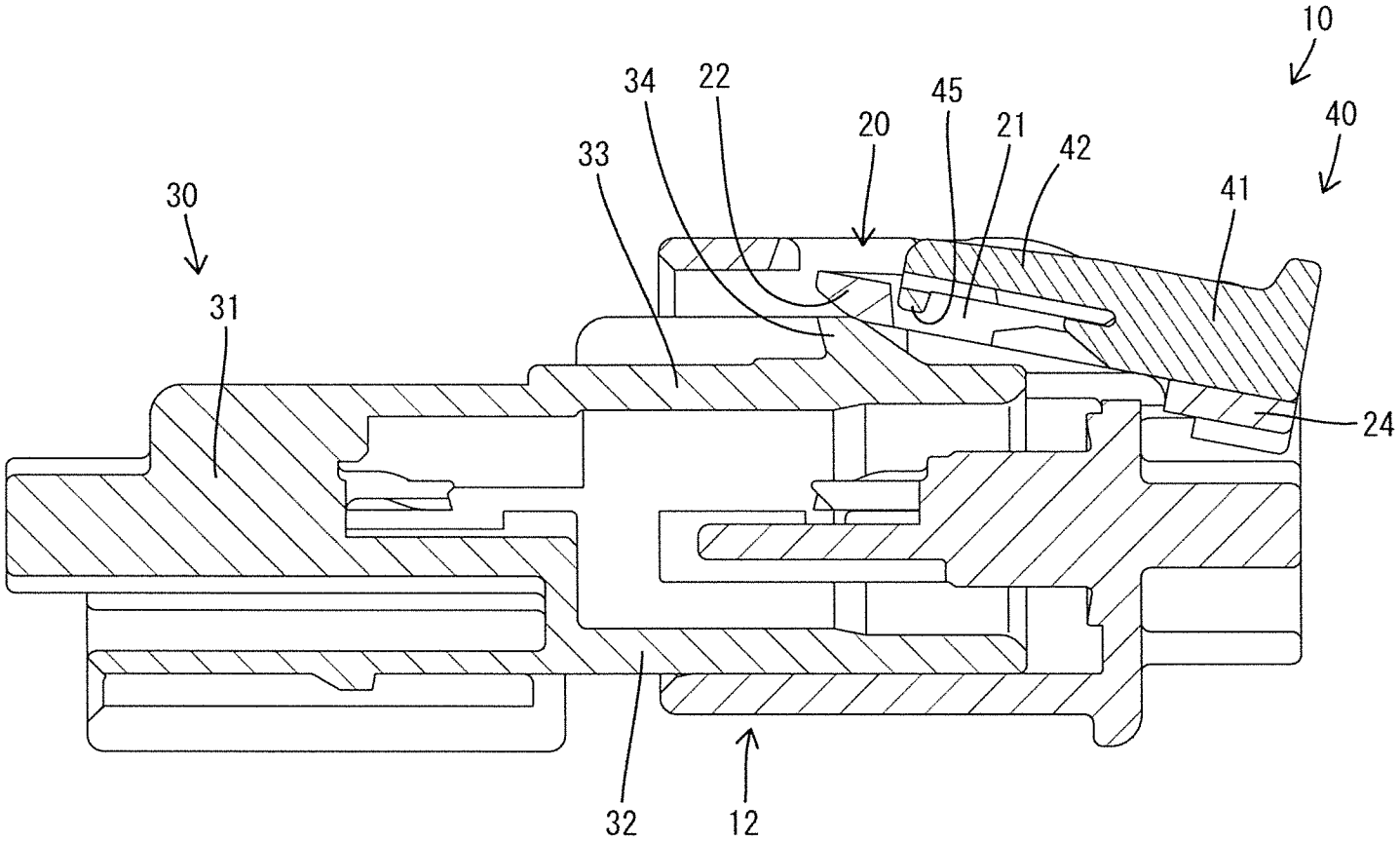
FIG. 3 is a section along A-A of FIG. 1 showing a state where a lock arm is resiliently displaced in an unlocking direction in the process of connecting the two housings.

The lock arm 20 is held at the locking position and the connection detector 40 is held at the initial position before the two housings 10, 30 are connected. The connection of the two housings 10, 30 then is started in this state. As a result, the interfering portion 22 of the lock arm 20 contacts the lock 34, as shown in FIG. 2. The interfering portion 22 moves onto the lock 34 as the connection proceeds and the lock arm 20 is displaced resiliently in the unlocking direction, as shown in FIG. 3. The connection detector 40 moves integrally with the lock arm 20 as the lock arm 20 is displaced to incline up toward the front. At this time, the two housings 10, 30 are half-connected.

The butting portion 45 is kept in contact with or proximately facing the interfering portion 22 from behind when the two housings 10, 30 are half-connected. Thus, the connection detector 40 is held at the initial position and cannot move to the detection position. In addition, the front end edges of the projections 46 of the connection detector 40 proximately face the movement restricting portions 19 at the same height. Thus, even if it is attempted to move the connection detector 40 forcibly to the detection position while the housings 10, 30 are half-connected, the contact of the butting portion 45 with the interfering portion 22 and the contact of the front end edges of the projections 46 with the movement restricting portions 19 prevent movement of the connection detector 40 to the detection position.

Figure 4:
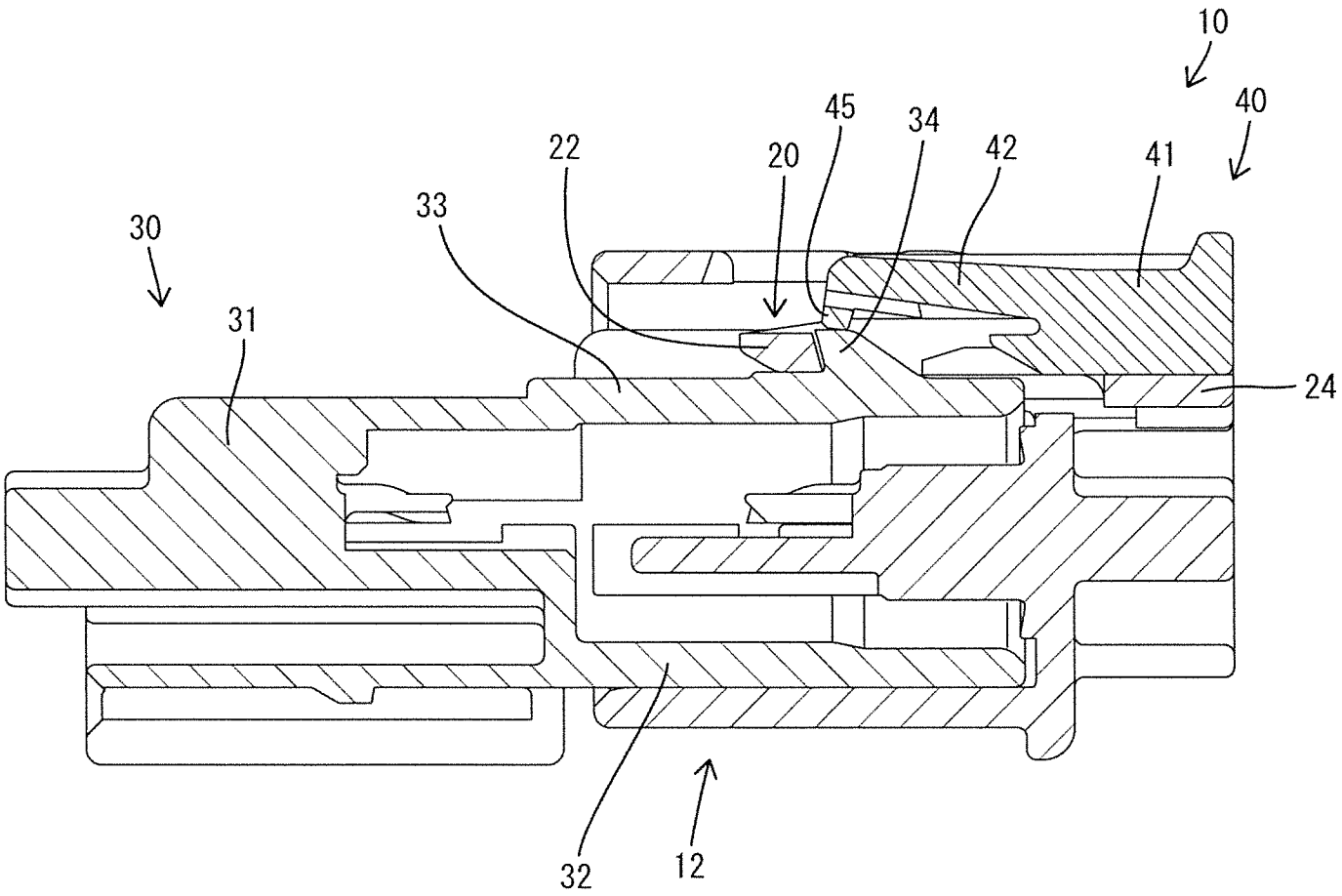
FIG. 4 is a section along A-A of FIG. 1 showing a state where the two housings are connected properly and a connection detector is at an initial position.
Figure 5:
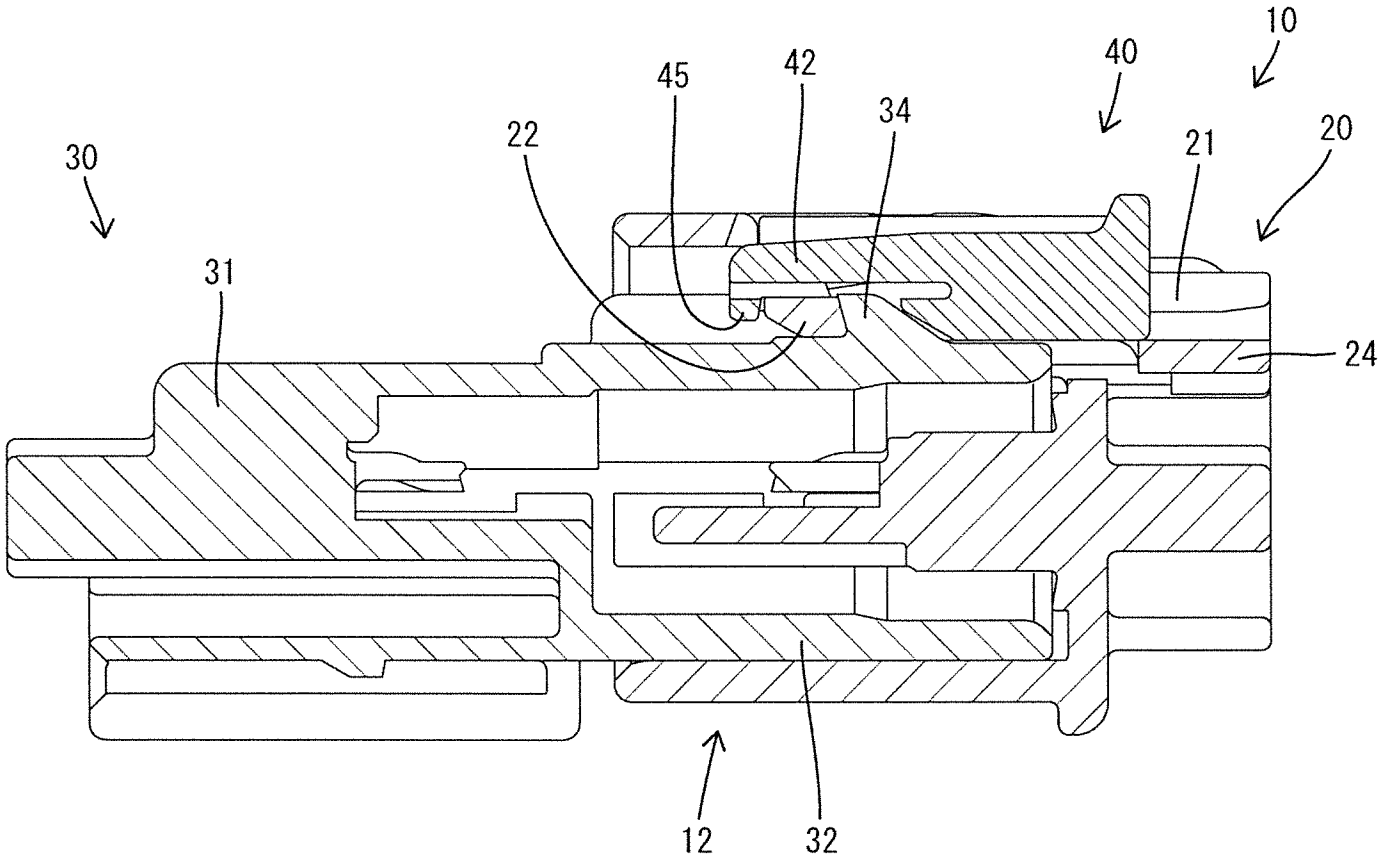
FIG. 5 is a section along A-A of FIG. 1 showing a state where the two housings are connected properly and the connection detector has moved to a detection position.
Figure 6:
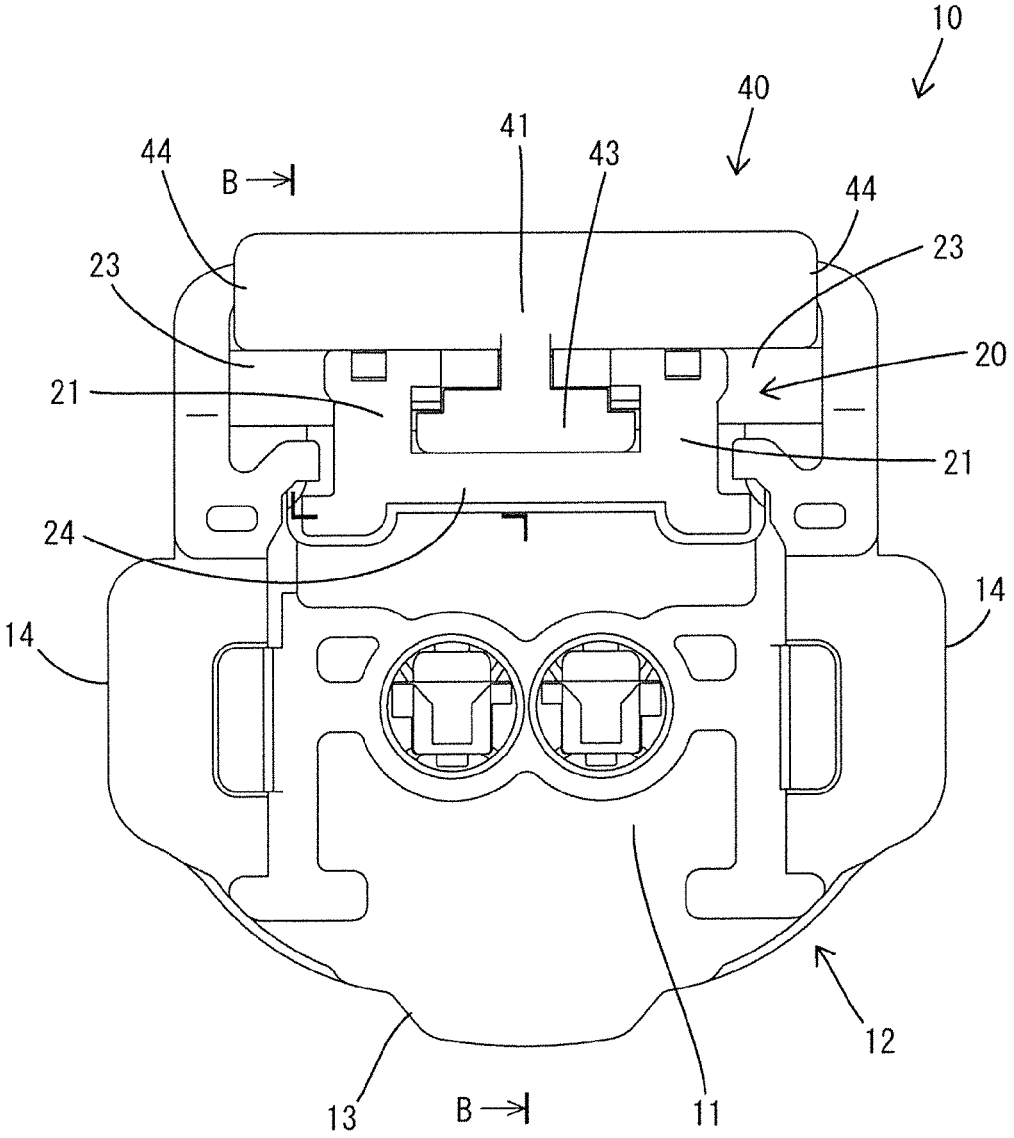
FIG. 6 is a rear view of the first housing.

The interfering portion 22 passes over the lock 34, as shown in FIG. 4, when the two housings 10, 30 reach a properly connected state. Thus, the lock arm 20 resiliently returns to the locking position and the interfering portion 22 is locked to or proximately faces the lock 34 from the front. Therefore, a locking action of the interfering portion 22 and the lock 34 restricts separation of the two housings 10, 30, even if an attempt is made to pull the housings 10, 30 apart.

A downward operating force can be applied to the upper surface of the plate-like main body 41 of the connection detector 40 when the housings 10, 30 are connected properly and the connection detector 40 is at the initial position. That operating force acts on the coupling 24 of the lock arm 20 via the leg 43 and resiliently displaces the lock arm 20 in the unlocking direction. Hence, the interfering portion 22 disengages from the lock 34 and the housings 10, 30 can be separated.

The lock arm 20 returns resiliently to the locking position when the two housings 10, 30 are connected properly. Additionally, the main body 41, the leg 43 and the wings 44 of the connection detector 40 return with the lock arm 20 to their initial postures. However, the butting portion 45 of the connection detector 40 is kept located on the lock 34. Thus, as the lock arm 20 resiliently returns, the plate-like deflecting portion 42 is displaced and curves. The interfering portion 22 is displaced to escape down from the butting portion 45. As a result, the butting portion 45 is released from being held in contact with the interfering portion 22.

In this way, the connection detector 40 is made movable forward relative to the lock arm 20, and a forward pushing force can move the connection detector 40 to the detection position. Further, as described above, the movement of the connection detector 40 to the detection position is restricted in the state where the two housings 10, 30 are half-connected. Thus, the connected state of the two housings 10, 30 can be detected based on whether or not the connection detector 40 can be moved to the detection position.

The projections 46 start fitting into the recesses 17 when the connection detector 40 starts moving from the initial position to the detection position. The projections 46 slide in contact with the recesses 17 during the entire movement path of the connection detector 40 from the initial position to the detection position. This sliding contact guides the connection detector 40 in a state where a vertical movement thereof relative to the lock arm 20 and the inclination of the posture thereof are restricted. The projections 46 remain in the recesses 17 when the connection detector 40 has reached the detection position. The plate-like main body 41 may be pushed down so that an operating force in the unlocking direction is applied to the lock arm 20 in this state. The upper surfaces of the projections 46 contact the ceiling surfaces of the recesses 17 before the supports 23, thereby restricting a forward inclination of the connection detector 40. At this time, the reinforcing ribs 48 enhance the rigidity of the wings 44 so that the wings 44 do not curve or deform. In this way, a displacement of the lock arm 20 in the unlocking direction is restricted.

As described above, the connection detector 40 mounted on the lock arm 20 is movable in the front-back direction intersecting with the resilient displacement direction of the lock arm 20 between the initial position and the detection position, is kept at the initial position when the lock arm 20 is displaced in the unlocking direction and permitted to move to the detection position when the two housings 10, 30 are connected properly and the lock arm 20 has returned resiliently to the locking position. The first housing 10 has the supporting panels 16 substantially parallel to the resilient displacement direction of the lock arm 20. The wall surfaces of the supporting panels 16 have the recesses 17, and the connection detector 40 the projections 46 that fit in the recesses 17 for restricting a displacement of the lock arm 20 in the unlocking direction when the connection detector 40 is at the detection position.

An operating force in the unlocking direction applied to the lock arm 20 is received by the connection detector 40 and the recesses 17 via the projections 46 of the connection detector 40. The supporting panels 16 formed with the recesses 17 stand up substantially parallel to the resilient displacement direction of the lock arm 20 and are highly rigid against the operating force acting on the recesses 17 in the unlocking direction. Thus, a resilient displacement of the lock arm 20 in the unlocking direction reliably is restricted.

Further, the recesses 17 are grooves extending parallel to the moving direction of the connection detector 40. Thus, the projections 46 do not correspond to the recesses 17 when the connection detecting member 40 is at the initial position, and the projections 46 slide in contact with the recesses 17 as the connection detector 40 moves from the initial position to the detection position. By this configuration, the sliding contact of the projections 46 and the recesses 17 smoothly guides the connection detector 40 during movement between the initial position and the detection position. In addition, the projections 46 are ribs extending parallel to the moving direction of the connection detector 40. Thus, the posture of the connection detector 40 during movement is stabilized and a high guiding function is exhibited.

Further, the movement restricting portions 19 restrict movement of the connection detector 40 toward the detection position by proximately facing the projections 46 when the lock arm 20 is displaced resiliently in the unlocking direction. According to this configuration, even if an attempt is made to move the connection detector 40 forcibly to the detection position while the two housings 10, 30 are half-connected, the projections 46 contact the movement restricting portions 19 to prevent movement of the connection detector 40 to the detection position.

The invention is not limited to the above described and illustrated embodiment. For example, the following embodiments also are included in the scope of the invention.

Although the recesses are grooves in the above embodiment, a dimension of the recesses in the moving direction of the connection detector may be substantially equal to an opening dimension of the recesses in a direction intersecting with the moving direction of the connection detector.

The projections extend in a rib-like manner in the above embodiment. However, a dimension of the projections in the moving direction of the connection detector may be equal to a thickness of the projections in a direction intersecting the moving direction of the connection detecting member.

The projections start fitting in the recesses immediately after the connection detector starts moving from the initial position to the detection position and the fitted state is maintained until the detection position is reached in the above embodiment. However, the projections and the recesses may be first fit immediately before the connection detector reaches the detection position.

LIST OF REFERENCE SIGNS

10 . . . first housing
16 . . . supporting panel
17 . . . recess
19 . . . movement restricting portion
20 . . . lock arm
30 . . . second housing
40 . . . connection detector
46 . . . projection

What is claimed is:

1. A connector, comprising:

a first housing;

a second housing that is connectable to the first housing;

a lock arm formed on the first housing and having an interfering portion that engages the second housing to resiliently displace the lock arm in an unlocking direction in the process of connecting the two housings and the lock arm resiliently returning to a locking position so that the interfering portion is locked to the second housing when the two housings are connected properly;

a connection detector mounted on the lock arm, and movable in an inserting direction intersecting a resilient displacement direction of the lock arm between an initial position and a detection position, the connection detector having a deflecting portion cantilevered forward in the inserting direction and a butting portion at a leading end of the deflecting portion in the inserting direction and configured to engage the interfering portion of the lock arm at the initial position when the lock arm is displaced resiliently in the unlocking direction, and moving over the interfering portion and to the detection position when the two housings are connected properly and the lock arm has returned resiliently to the locking position;

two opposed supporting panels formed on the first housing and being substantially parallel to the resilient displacement direction of the lock arm;

recesses formed in opposed wall surfaces of the supporting panels; and two projections projecting laterally in opposite directions from the connection detector at positions spaced laterally from the deflecting portion and rearward of the butting portion relative to the inserting direction, the projections restricting a displacement of the lock arm in the unlocking direction by being fit into the recesses when the connection detector is at the detection position.

2. The connector of claim 1, wherein:

the recesses are grooves extending parallel to the inserting direction of the connection detector;

the projections and the recesses do not correspond when the connection detector is at the initial position; and the projections slides in contact with the recesses when moving the connection detector from the initial position to the detection position.

3. The connector of claim 2, wherein:

the projections are ribs extending parallel to the inserting direction of the connection detector.

4. The connector of claim 1, further comprising:

a movement restricting portion formed in the first housing and restricting a movement of the connection detector toward the detection position by proximately facing the projections when the lock arm is displaced resiliently in the unlocking direction.

5. The connector of claim 1, wherein the connection detector has a main body at a rear end thereof in the inserting direction, wings formed on opposite sides of the main body and projecting forward from the main body at positions spaced laterally from the deflecting portion.

6. The connector of claim 5, wherein the projections are formed on the wings.

7. The connector of claim 6, further comprising reinforcing ribs formed respectively on the wings and extending in the inserting direction.

8. The connector of claim 7, wherein the reinforcing ribs are at positions on the wings laterally inward of the projections.

9. The connector of claim 1, wherein the projections and the deflecting portions are substantially coplanar.

* * * * *